US008449416B2

(12) United States Patent
Grace et al.

(10) Patent No.: US 8,449,416 B2
(45) Date of Patent: May 28, 2013

(54) MECHANICAL BROADHEAD

(75) Inventors: Nathaniel E. Grace, Port Huron, MI (US); John H. Brywig, Carsonville, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 13/347,257

(22) Filed: Jan. 10, 2012

(65) Prior Publication Data

US 2012/0178560 A1 Jul. 12, 2012

Related U.S. Application Data

(60) Provisional application No. 61/431,473, filed on Jan. 11, 2011.

(51) Int. Cl.
*F42B 6/08* (2006.01)

(52) U.S. Cl.
USPC ..... 473/583

(58) Field of Classification Search
USPC ..... 473/583, 584
See application file for complete search history.

(56) References Cited

U.S. PATENT DOCUMENTS

| | | | | |
|---|---|---|---|---|
| 2,993,697 | A | 7/1961 | Urban | |
| 4,099,720 | A | 7/1978 | Zeren | |
| 4,579,348 | A | 4/1986 | Jones | |
| 4,973,060 | A | 11/1990 | Herzing | |
| 4,998,738 | A | 3/1991 | Puckett | |
| 5,082,292 | A | 1/1992 | Puckett et al. | |
| 5,090,709 | A | 2/1992 | Johnson | |
| 5,102,147 | A | 4/1992 | Szeluga | |
| 5,112,063 | A | 5/1992 | Puckett | |
| 5,286,035 | A | 2/1994 | Ward | |
| 5,322,297 | A | 6/1994 | Smith | |
| 5,417,440 | A | 5/1995 | Barrie et al. | |
| 5,564,713 | A * | 10/1996 | Mizek et al. | 473/583 |
| 5,941,784 | A | 8/1999 | Mizek | |
| 6,165,086 | A * | 12/2000 | Liechty, II | 473/583 |
| 6,174,252 | B1 | 1/2001 | Mizek | |
| 6,200,237 | B1 | 3/2001 | Barrie | |
| 6,270,435 | B1 | 8/2001 | Sodaro | |
| 6,283,880 | B1 | 9/2001 | Barrie | |
| 6,287,224 | B1 * | 9/2001 | Liechty, II | 473/584 |
| 6,290,903 | B1 | 9/2001 | Grace, Jr. et al. | |
| 6,398,676 | B1 | 6/2002 | Mizek | |

(Continued)

OTHER PUBLICATIONS

New Archery Products Broadheads downloaded from http://www.newarchery.com/products/1/broadheads on Jan. 4, 2012.

(Continued)

*Primary Examiner* — John Ricci
(74) *Attorney, Agent, or Firm* — Warner Norcross & Judd LLP

(57) ABSTRACT

A mechanical broadhead having blades movable from a retracted mode to a deployed mode is provided including a generally external retainer element which holds the blades in the retracted mode, but also selectively releases the blades so that they can transition to the deployed mode. The retainer element can include a collar and one or more tabs. A blade can include a projection and/or a recess that is engaged by one or more tabs to secure the blade in the retracted position. The tabs can be paired and can define a retainer slot therebetween. The blade can be at least partially disposed in the retainer slot in the retracted mode and/or in the deployed mode.

19 Claims, 6 Drawing Sheets

U.S. PATENT DOCUMENTS

| | | | | |
|---|---|---|---|---|
| 6,517,454 | B2 | 2/2003 | Barrie et al. | |
| 6,595,881 | B1 | 7/2003 | Grace, Jr. et al. | |
| 6,626,776 | B2 | 9/2003 | Barrie et al. | |
| 6,669,586 | B2 | 12/2003 | Barrie et al. | |
| 6,749,801 | B1 | 6/2004 | Grace, Jr. et al. | |
| 6,910,979 | B2 | 6/2005 | Barrie et al. | |
| 6,935,976 | B1 | 8/2005 | Grace, Jr. et al. | |
| 6,942,588 | B2 | 9/2005 | Barrie | |
| 6,997,827 | B1 | 2/2006 | Grace, Jr. et al. | |
| 7,013,772 | B1 | 3/2006 | Grace, Jr. et al. | |
| 7,182,706 | B2 | 2/2007 | Barrie | |
| 7,226,375 | B1 | 6/2007 | Sanford | |
| 7,234,220 | B1 | 6/2007 | Grace, Jr. | |
| 7,314,419 | B2 | 1/2008 | Grace et al. | |
| RE40,273 | E | 4/2008 | Grace, Jr. et al. | |
| 7,708,659 | B2 | 5/2010 | Grace, Jr. | |
| 7,771,298 | B2 | 8/2010 | Pulkrabek | |
| 7,951,024 | B2 | 5/2011 | Mizek | |
| 8,043,177 | B2 * | 10/2011 | Flanagan | 473/583 |
| 8,182,378 | B1 * | 5/2012 | Futtere | 473/583 |

OTHER PUBLICATIONS

Grim Reaper Broadhead Assembly downloaded from http://www.youtube.com/watch?v=mlpechah4rc on Dec. 21, 2011.

Tekan II Broadhead downloaded from http://www.sportsmansguide.com/net/cb/g5-tekan-ii-100-gr-broadhead.aspx?a=277261 on Jan. 6, 2012.

* cited by examiner

MECHANICAL BROADHEAD

BACKGROUND OF THE INVENTION

The present invention relates generally to a mechanical broadhead, and more particularly, to a mechanical broadhead including movable blades, such as rearward deploying/sliding blades or pivoting blades.

A mechanical broadhead, sometimes referred to as an expanding blade broadhead, includes blades joined with a ferrule so that the blades can move from a retracted in-flight position to a deployed position upon engagement with a target. Mechanical broadheads generally have the flight characteristics of a field point, yet the penetration and cutting characteristics of a fixed blade broadhead.

One type of mechanical broadhead is a pivoting blade broadhead. This broadhead includes blades located in a slot defined by a ferrule so that the cutting edges of the blades face inward in the retracted, in-flight position. The blades are pivotally joined with the ferrule at their rear so they can rotate from the retracted, in-flight position to a deployed position on impact with the target. In the deployed position, the cutting edges of the blades face outward so that they can enhance penetration and cutting action.

Another type of mechanical broadhead is a rearward deploying or sliding blade broadhead. Such broadheads generally include blades having cutting edges that always face outwardly, and that are designed to slide rearward relative to a ferrule from a retracted in-flight mode to a deployed mode.

Almost all mechanical broadheads include a mechanism to retain the blades in a retracted mode while the broadhead is in-flight. Some rearward deploying broadheads and some pivoting broadheads use O-rings, wraps or bands secured around the blades and the ferrule to hold the blades in-flight. When the blades deploy, these devices are cut, or roll or slide off the broadhead. Many of these devices, however, are prone to rotting or cracking, which can lead to failure of the device, and possibly the unintended and undesirable opening of the blades in-flight. Further, some pivoting blade broadheads use blade detents or a plunger system located internally within the ferrule to secure the pivoting blades in the in-flight position. These items, however, usually are complicated and sometimes difficult to use.

SUMMARY OF THE INVENTION

A mechanical broadhead having blades movable from a retracted mode to a deployed mode is provided including a generally external retainer element which holds the blades in the retracted mode, but also selectively releases the blades so that they can move to the deployed mode.

In one embodiment, the broadhead includes a ferrule having an exterior and defining a ferrule slot, and a blade movably positioned in the ferrule slot. The blade is configured to rotate about an axis of rotation. The blade includes a blade surface having at least one of a projection and a recess located at least partially on the exterior of the ferrule. The retaining element engages the at least one of the projection and the recess, and effectively holds the blade in a retracted mode.

In another embodiment, the blade surface is a blade side surface, located between a blade cutting edge and a blade inner edge. The blade side surface includes a projection. The retainer element includes at least one tab, also referred to as a finger herein, which engages the projection on the side surface of the blade to hold the blade in the deployed mode.

In still another embodiment, the retainer element includes a tab that engages an inner edge surface of the blade in a location adjacent the exterior of the ferrule. The tab engages a recess to hold the blade in the deployed mode.

In still yet another embodiment, the retainer element includes a collar and one or more resilient tabs that engage the blade. The resilient tabs can urge another portion of the blade to engage a portion of the ferrule and thereby hold the blade in a retracted mode.

In yet another embodiment, where the retainer element includes a collar, the ferrule can include a stem, and the collar can be placed on the stem. Optionally, the collar circumferentiates the stem. The collar also can be sandwiched generally between the ferrule and an insert of an arrow or the arrow to which the broadhead is attached.

In still another embodiment, the retainer element includes a plurality of tabs disposed radially about a collar. The tabs can be paired, with slots or recesses defined between adjacent paired tabs. The slots can be shaped and/or sized to accommodate a blade disposed at least partially therein.

In even another embodiment, paired tabs can be configured to straddle at least a portion of a blade, with the portion of the blade disposed within the slot when the blade is in a retracted mode. Optionally, the tabs can engage projections extending from opposing sides of the blades.

In a further embodiment, the tabs resiliently engage the blades of the broadhead to retain the blades in a retracted mode. Upon engagement with a target, the blades move sufficiently so that the tabs disengage the blades, for example, the projections, recesses, and/or edges of the blades, so that the blades can move to a deployed mode.

The broadhead of the embodiments herein provides an efficient mechanism by which to securely hold blades of the broadhead in a retracted mode. The retainer element can withstand the elements and generally is of a durable, long lasting and optionally reusable construction.

These and other objects, advantages and features of the invention will be more readily understood and appreciated by reference to the detailed description of the current embodiments and the drawings.

DETAILED DESCRIPTION OF THE CURRENT EMBODIMENTS

Figure 1:
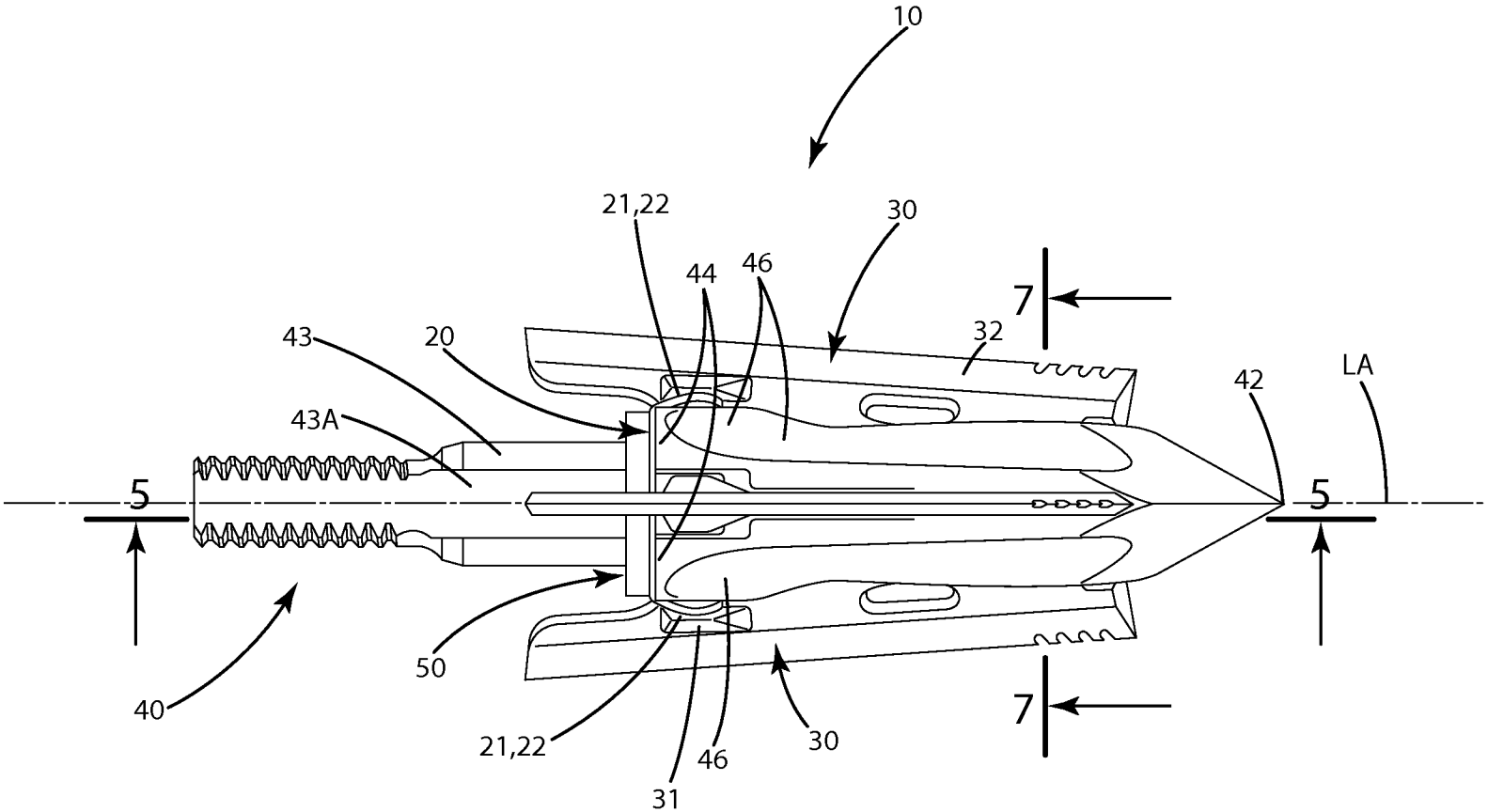
FIG. 1 is a side view of a broadhead of a current embodiment with the blades in a retracted mode.

A current embodiment of the broadhead is shown in FIGS. 1-8 and generally designated 10. The broadhead can include a retainer element 20, one or more blades 30 joined with a ferrule 40 and an optional spacer 50. For purposes of disclosure, the broadhead is described in connection with use on an archery arrow, however, the broadhead is well suited for use with any projectile.

The broadhead of the current embodiment generally is a rearward deploying, sliding blade type broadhead. This type of broadhead transitions from a retracted mode as shown in FIG. 1 to a retracted mode shown in phantom lines in FIG. 5. In the retracted mode, the broadhead is generally of a smaller cross section so that it performs well in flight. In the expanded mode, the blades 30 are rearwardly deployed to increase the cutting area of the broadhead. The constructions herein also are suitable for use with other rearward deploying broadheads, such as those disclosed in U.S. Pat. No. 6,935,976 to Grace, and copending U.S. application Ser. No. 13/330,064 to Grace, entitled "Mechanical Broadhead," filed Dec. 19, 2011, both of which are hereby incorporated by reference. Of course, the constructions herein are also suited for use with rearward pivoting type broadheads, of the type generally shown in FIG. 13 and described below, or disclosed in U.S. Pat. No. 6,595,881 to Grace, which is hereby incorporated by reference.

Returning to FIGS. 1 and 5-8, the broadhead 10 includes a ferrule 40. The forward portion of the ferrule 40 includes a penetrating tip 42. The penetrating tip may be an integral or removable feature, and can be sharpened to enhance penetration upon engagement with a target. The rearward end of the ferrule includes a stem 43. The stem 43 can include threads or other suitable structures to enable attachment of the ferrule 40 to an arrow insert or more generally to an arrow (not shown). The ferrule 40 further can define a longitudinal axis LA that extends longitudinally along the length of the ferrule 40, generally through the center of the ferrule.

Figure 8:
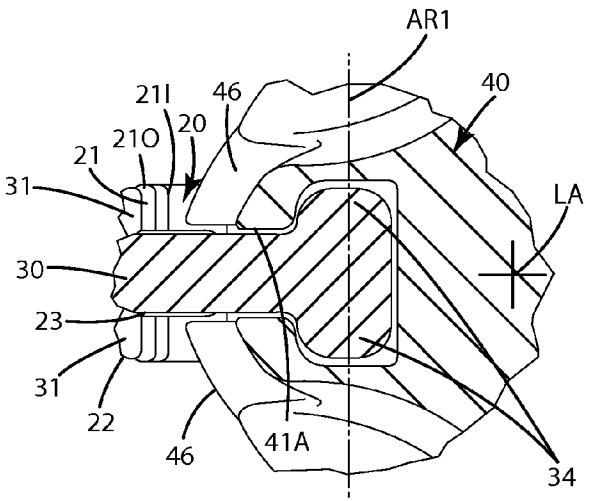
FIG. 8 is a close up view of the retainer element engaging the blade of the broad head.
Figure 7:
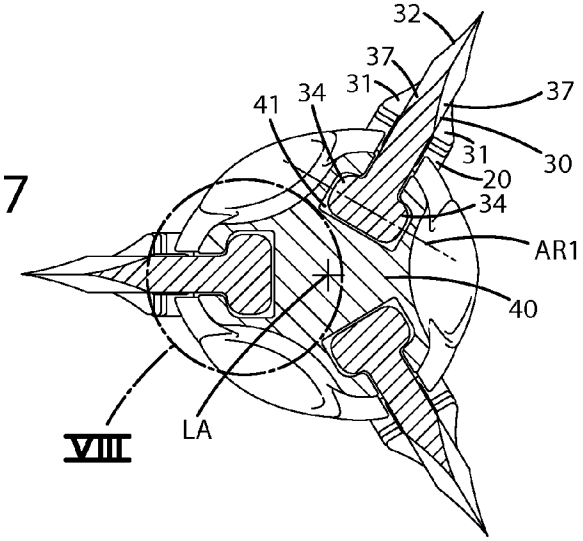
FIG. 7 is a section view of the broadhead taken along line 7-7 of FIG. 1.

The ferrule 40 can define ferrule slots 41 that extend along its length. The ferrule slots can be configured to accommodate a portion of the blades 30 as described below. The ferrule slots 41, as shown in FIGS. 7 and 8, can be of a T-shaped structure with a portion of the blade extending transversely to the longitudinal axis and journaled within the slot 41. The ferrule 40 can include a rearward shoulder 44 located adjacent the portion of the ferrule 40 where the stem 43 begins. The shoulder 44 can be configured to abut against at least a portion of the retainer element 20 as described below.

Figure 5:
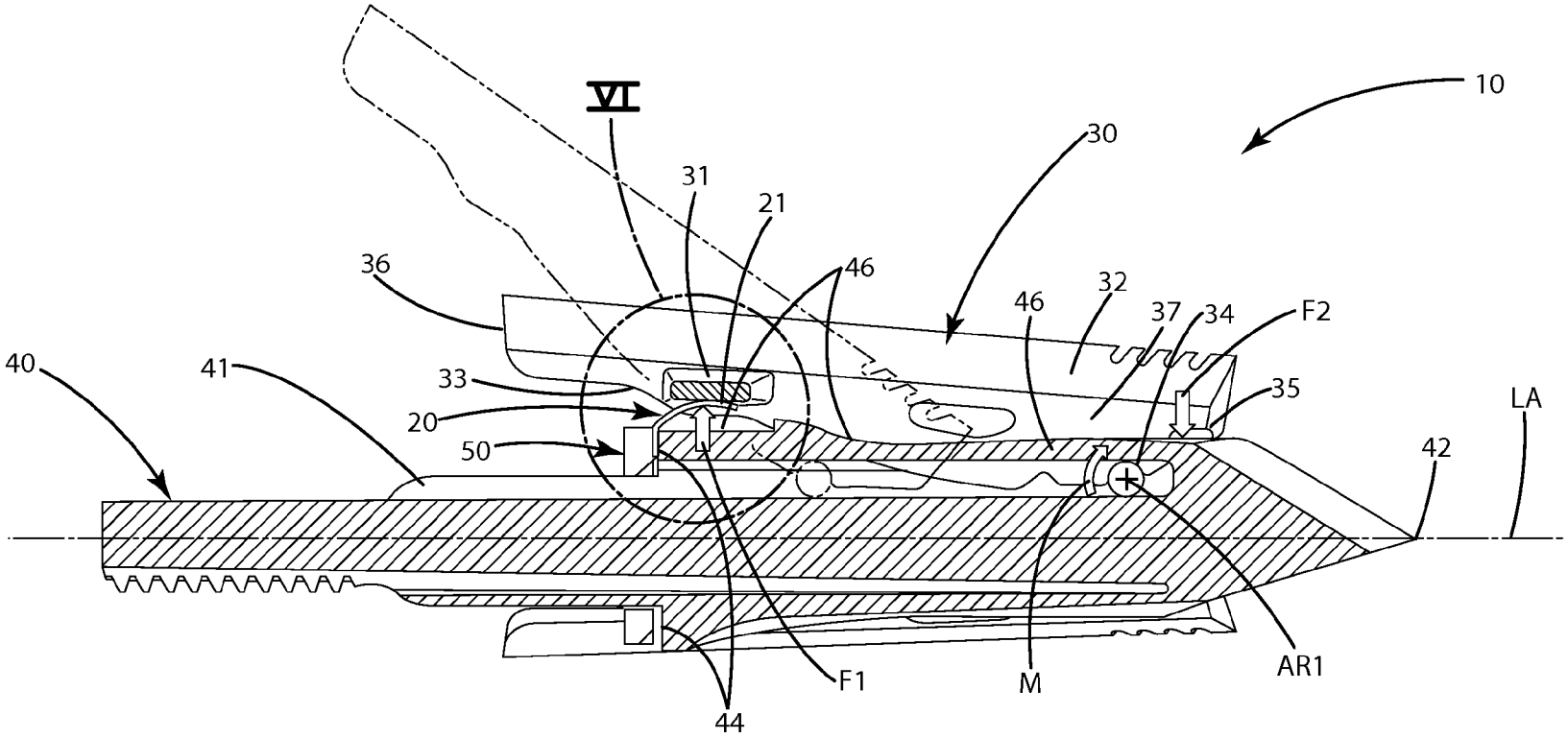
FIG. 5 is section view of the broadhead taken along line 5-5 of FIG. 1.
Figure 6:
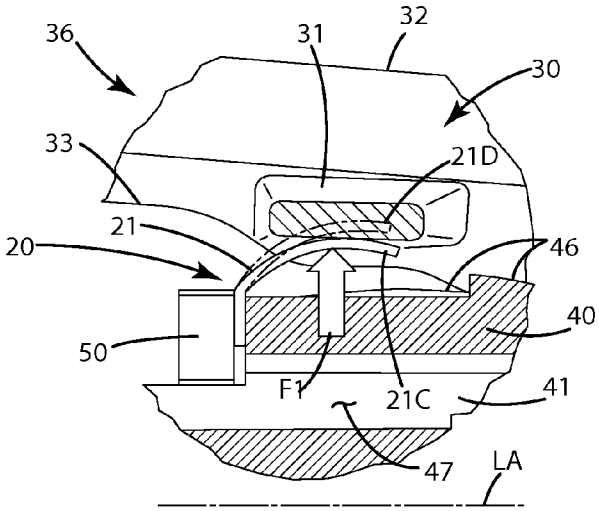
FIG. 6 is a close up view of the retainer element engaging a blade of the broad head.

As shown in FIGS. 1, 5, and 6, the ferrule 40 can define an exterior surface 46 which is generally the surface that is open and visible to a casual observer of the broadhead when installed on an arrow or generally in an assembled state. The exterior surface 46 can include all the visible surface on the exterior of the ferrule. The exterior surface 46 can be differentiated from the interior 47 (FIG. 6) of the broadhead which interior is not visible to a casual observer of the broadhead when it is in an assembled state. The interior 47 of the broadhead can house or include any internal compartments or components. The interior portion of the ferrule slots 41 are located on the interior 47 of the ferrule 40 while the penetrating tip 42, cutting edges 32 and tabs 21 and 22 of the retainer element 20 are disposed on or adjacent the exterior surface of the ferrule 40, generally outside the ferrule.

The blades 30 are movably joined with the ferrule 40, and are configured to translate from a retracted mode to a deployed mode as shown in FIG. 5. Each blade can include a forward end 35 and a rearward end 36. A cutting edge 32 can extend from the forward end 35 to the rearward end 36. The cutting edge can be sufficiently sharp to cut tissue or any other target that the broadhead 10 engages. The blades 30 can include an inner edge 33, which is located inward, closer to the longitudinal axis LA than the cutting edge 32 in the embodiments illustrated in FIGS. 1-11. In the illustrated rearwardly deploying broadhead, the outer cutting edge 32 remains positioned radially outwardly relative to the longitudinal axis LA, that is, it faces outward in both the retracted mode and in the deployed mode. The inner edge 33 also remains facing generally inwardly, radially toward the longitudinal axis LA in both the retracted mode and the deployed mode.

Generally the blade 30 can be movably positioned in the ferrule slot 41, which means that it can slide and/or rotate relative to the ferrule 40 in the ferrule slot 41. In some embodiments herein, the blade 30 can slide relative to the slot generally away from the penetrating tip 42. Simultaneously, or at some other time, it can rotate about the axis of rotation AR1. In other embodiments, the blade can be movably positioned in the ferrule slot and can rotate in or out of the ferrule slot about a fixed axis of rotation.

The blades 30 can include a projection 34, which as shown, can be in the form of a boss. Of course, the projection 34 can be replaced with any suitable feature adapted to engage the ferrule slot 41 and enable the blade to rotate generally about the axis of rotation AR1 in deploying from a retracted mode to an expended mode as shown in FIG. 5.

The blades can include a retainer projection 31 which as shown in FIGS. 1-8, generally extend from a side surface 37 of the blade. Optionally, each blade 30 can include opposing blade side surfaces 37 (FIG. 6), and from each of those blade side surfaces, the projections 31 can extend. Alternatively, if the blade surfaces define recesses, those recesses can be defined in opposing side surfaces, and/or can be formed as an aperture or a hole that extends partially or entirely through the blade as described further below.

As illustrated, the projection 31 can be disposed rearwardly of the blade projection 34 about which the blade rotates relative to the axis of rotation AR1. The projection 31 can extend outwardly from the blade side surface 37 a distance so that the retainer element 20, and more particularly one or more of its tabs 21, 22, can engage the projection 31 sufficiently to hold the blade 30 in the retracted mode upon such engagement. The projection 31 is shown as being of an elongated construction that extends a length along the longitudinal axis LA. Of course, this shape can be substituted with a rounded or dome-shaped projection that likewise can be configured to adequately engage the tabs 21, 22 or other features of the retainer element. Further, although shown as structures integral with the blades 30, the projections 31 can be separately formed structures joined with the blades. For example, the projections 31 could be pins or fasteners joined with the side surfaces of the blades, or pins or fasteners or other elements projecting through, but secured within holes defined by the blades (not shown).

The ferrule, blades and other components of the broadhead can be manufactured from metal, composites, polymers, or combinations of the foregoing. Suitable metals include aluminum, stainless steel and/or titanium. If the ferrule is constructed from metal, it can be machined from bar stock or formed using metal injection molding (MIM) optionally followed with a secondary machining operations. If the ferrule or other components are constructed from composites or polymers, the tip and the blades optionally can be manufactured separately from other materials such as metals.

Figure 2:
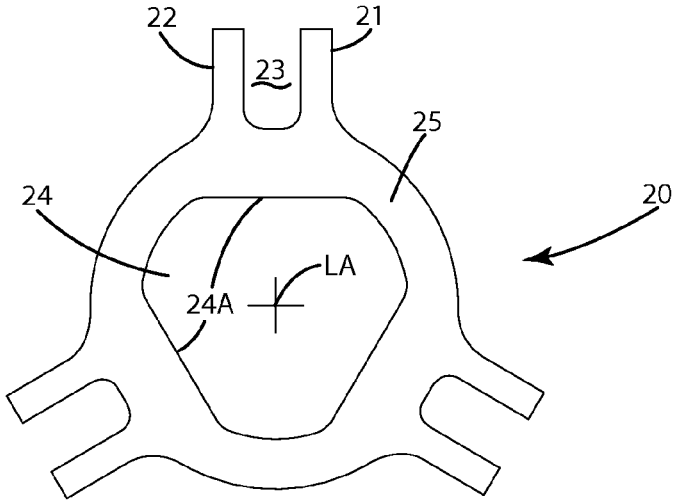
FIG. 2 is a top view of a retainer element of the broadhead.

The broadhead 10 can include a retainer element 20 which, as shown in FIGS. 1-8, includes a collar or base 25. The collar or base 25 defines an aperture 24. The aperture can be of a sufficient size for the stem 43 to be inserted at least partially therethrough. As illustrated in FIG. 2, the aperture 24 can include a periphery that is of a predesired shape including one or more registration or indexing elements 24A, which as shown are in the form of flat surfaces on the periphery of the collar surrounding the aperture. These registration elements can be keyed to the stem 43 to enable the respective tabs 21, 22 of the retaining element 20 to be registered in alignment with the blades 30 of the broadhead or other features of the broadhead as desired. Likewise, as shown in FIG. 1, the stem 43 can include corresponding features, such as lands 43A, that register with the registration elements 24A of the retaining element 20. Optionally, the registration elements register with the stem or ferrule, the collar and retainer element can be restrained from rotating about the longitudinal axis LA. Optionally, the axis of the retainer element 20 is coincident and parallel to the longitudinal axis LA of the broadhead, and more particularly the ferrule 40.

Figure 3:
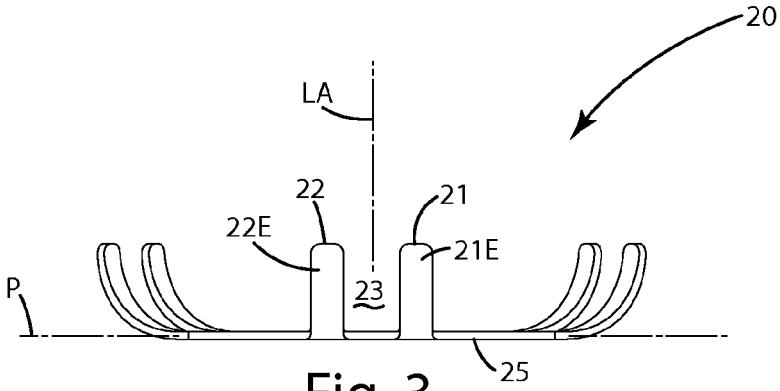
FIG. 3 is a front view of the retainer element.
Figure 4:
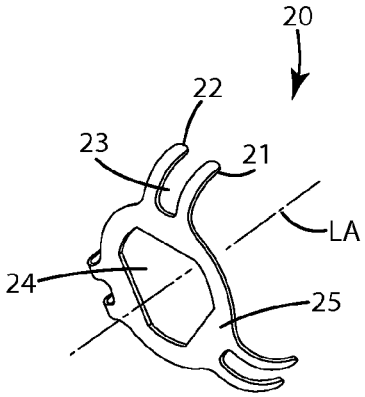
FIG. 4 is a perspective view of the retainer element.

As shown in FIGS. 2-4, the retaining element 20 also can include one or more tabs. These tabs can be paired or generally in sets including a first tab 21 and a second tab 22. These first and second tabs 21, 22 can be reproduced about the collar, depending on the number of blades in the broadhead. As illustrated in FIGS. 1-8, there are three sets of two tabs each for the three blade construction of that broadhead. Of course, the number of tabs can be modified depending on the number of blades and the desired engagement of the tabs with the blades.

The first and second tabs 21, 22 can extend generally radially outwardly away from the longitudinal axis LA. The tabs 21, 22 can be of an arcuate and/or angled construction depending on the projection or recess utilized with the blades 30 and/or desired performance characteristics. As shown in FIG. 3, the tabs 21 and 22 can extend outwardly from the collar 24 and can terminate at their respective ends 21E and 22E. These ends can be located above the plane P in which the collar 25 generally is located.

As shown in FIGS. 5 and 8, the first and second tabs 21, 22 can extend outside the ferrule, generally outward and away from the exterior surface 46 of the ferrule 40. Optionally, the tabs can be disposed adjacent the exterior surface 46, and located outside the ferrule slots 41. As shown in FIG. 8, the tabs can include an outer surface 210 and an inner surface 211. Outer surface 210 can face outwardly, away from the exterior surface 46. Inner surface 211 can face inwardly, toward the exterior surface 46 of the ferrule 40, and/or generally toward the longitudinal axis LA.

The first and second tabs 21 and 22 can define a retainer slot 23 therebetween. The retainer slot 23 can be sized so that a respective blade 30 can slide or can be positioned at least partially between the respective first and second tabs 21 and 22. For example, as shown in FIGS. 5 and 8, the inner edge 33 of the blade 30 is disposed between the first and second tabs 21 and 22, and optionally located within the retainer slot 23. Other surfaces, beside the inner edge 33 of the blade 30, can also or alternatively be disposed in the retainer slot 23, generally between the first and second tabs 21 and 22 depending on the application.

The tabs 21, 22 can be constructed from the same material as the remainder of the retainer element 20. These tabs can be constructed of a resilient material, in which case they are considered resilient tabs and can perform so that they are able to resiliently deform when engaged by the blades. The tabs also can operate to bias a portion of the blade, for example, the rearward end 36 of the blade outwardly away from the longitudinal axis LA as shown in FIG. 5 and further described below.

The first and second tabs 21, 22 can be oriented to generally straddle the blade 30 and engage the respective projections 31 on opposing side surfaces of the blade 30. The tabs 21 and 22 can also be positioned so that they extend outwardly on an exterior surface 46 of the ferrule 40 when the collar 25 is brought into engagement with the shoulder 44 of the ferrule 40. With this construction, the tabs generally extend away from the stem 43 and/or upwardly toward the penetrating tip 42 of the ferrule. Of course, if desired, tabs could extend rearwardly away from the penetrating tip 42 toward the stem 43 in other applications as desired.

The tabs 21 and 22 can be of a generally arcuate construction so as to facilitate sliding of the projection relative to their surfaces. Of course, the tabs can be of other angled or compound shapes depending on the desired performance characteristics.

Returning to FIGS. 2 and 8, the retainer slot 23 can be aligned with the ferrule slot 41, and in particular the ferrule slot opening 41A. With this construction, as the blade 30 transitions from a retracted mode to the deployed mode, the blade 30 can slide through a portion of the ferrule slot 41 and opening 41A, as well as at least partially through the retainer slot 23 of the retainer element 20.

The retainer element 20 can be constructed from a flat piece of thin metal, a composite, or a polymer. The retainer element 20 can be of a more three-dimensional configuration such as that shown in FIGS. 2-4. Generally, the retainer element and its components, such as the tabs, can be constructed from a resilient material. When a structure such as the retainer element is constructed from a resilient material, the material enables the structure, after being deformed from an original shape to a second shape, to transform back to its original shape after the external force causing the deformation is removed. Optionally, the retainer element and its components can be constructed from a suitable grade and thickness of spring steel, or some material possessing similar properties as spring steel. Other suitable materials could be certain composites or polymeric materials.

The broadhead 10 also can include a spacer 50. The spacer 50 can define an aperture that fits over the stem 43 of the ferrule 40. The spacer 50 can effectively sandwich the retainer element 20 between itself and the broadhead to facilitate installation of the broadhead on an arrow. Optionally the spacer 50 may or may not include registration or alignment elements similar to the registration elements 24A of the retainer element 20.

Operation of the broadhead 10 will now be described with reference to FIGS. 4-6. Generally the ferrule 40 is provided, and the blades 30 are installed relative to the ferrule 40 by inserting and sliding the blades within the ferrule slots 31. The projection 34 of the blades 30 can register with the ferrule slots 41 to secure the blades 30 to the ferrule 40. With the blades generally installed, the retainer element 20 can be installed on the stem 43 of the ferrule. The registration elements 24A can register with the stem 43 to align the tabs 21 and 22 along the sides of the ferrule slot opening 41A. This also can align the retainer slot 23 with the ferrule opening 41A as well.

The retainer element 20 can be installed so that it engages the shoulder 44 of the ferrule. The washer 50, if desired, can be installed to sandwich the retainer element 20 between it and the shoulder 44 of the ferrule 40. The blades 30 can be pushed forward so that the forward end 35 of the blades engage the ferrule 40 near the penetrating tip 42. The blade is then moved within the retainer slot 23 so that the blade projections 31 engage the respective first and second tabs 21 and 22. The tabs 21 and 22, can be slightly larger in their unflexed or unbent state than when they are engaged with the projections 31. For example, as shown in FIG. 6, before the blade projection 31 engages the first tab 21, it is in a first orientation 21D as shown in broken lines. After the blade projection 31 is forced against the tab 21, the tab 21 can deform and/or bend slightly to its deformed and compressed state 21C. The tab 21 in this state exerts a force F1 radially outwardly from the longitudinal axis LA of the ferrule 40.

As shown in FIG. 5, the force F1 biases the tab 21 against the blade projection 31. In turn, this urges the blade to rotate about the axis of rotation AR1 in direction M. This creates a moment about the axis AR1 that translates to generate a force F2 at the forward end 35 of the blade against the ferrule 40. This can lock the blade in the retracted mode. When the forward end 35 of the blade 30 engages a target, the blade slides rearwardly, and in so doing rotates about the axis of rotation AR1. In moving rearwardly the blade projection 31 also eventually disengages the tabs 21 and 22, and slides through at least a portion of the retainer slot 23. As illustrated in FIG. 6 when the tab 21 disengages the blade projection 31, the tab can return to its original shape 21D shown in broken lines. In so doing, the free end of the tab 21E (FIG. 3) can extend and move radially outwardly, away from the longitudinal axis LA of the ferrule.

After the broadhead has engaged the target, it can later be removed. Where the retainer element 20 is not destroyed by engagement with the target, the blades can again be slid forwardly within the slots 41 to reengage the forward end 35 of the ferrule and the tabs with the blade projection 31 to secure the blades 30 again in the retracted mode.

Although shown with multiple paired tabs engaging projections on opposing sides of the blades, the broadhead can be constructed so that only a single tab engages a single projection from a single side surface or other surface of the blades. Alternatively, multiple tabs can be utilized with a collar to engage multiple projections on a single side or multiple sides of a blade, or other surfaces of a blade, as explained in the alternative embodiments below.

Figure 9:
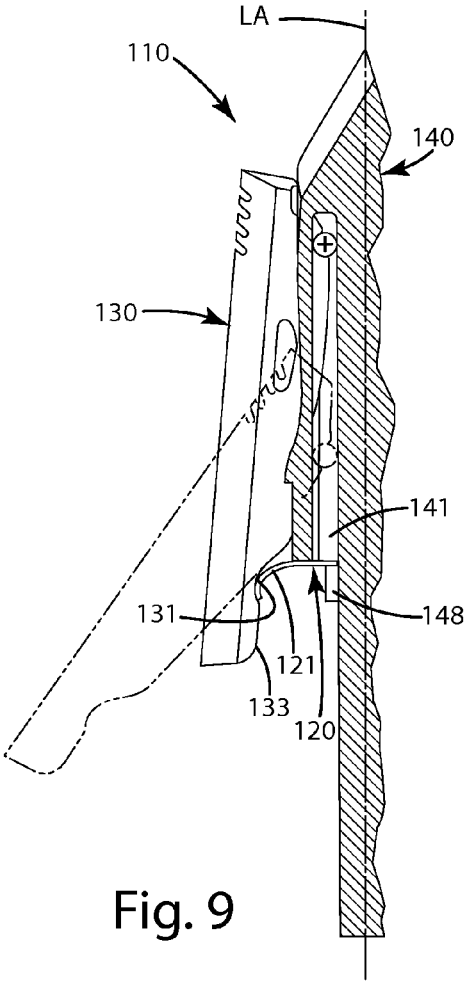
FIG. 9. is a section view of a first alternative embodiment of the broadhead including a retainer element.
Figure 10:
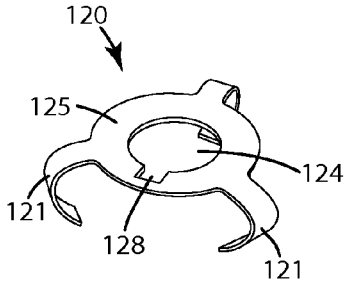
FIG. 10 is a perspective view of the retainer element thereof.

A first alternative embodiment of the broadhead is shown in FIG. 9 and generally designated 110. This embodiment is similar in construction and operation to the embodiment described above with a few exceptions. For example, the blade 130 includes a recess 131 defined on an inner edge 133 of the blade 130. This recess is configured to be engaged by a portion of the retainer element 120, and in particular an individual tab 121 that projects from a collar 125 of the retainer element 120. The tab 121 can be aligned in parallel with the ferrule slots 141 defined by the ferrule 140. The retainer element tab 121 also can be configured to resiliently engage the inner edge 133 of the blade to secure and hold it in a retracted mode as shown in FIG. 9, but still be sufficiently resilient to flex and allow the blade 130 to deploy to an expanded mode as show in broken lines in FIG. 9.

The tabs 121 are illustrated in a generally arcuate or curved configuration. As desired, however, they may be of a simple angled configuration and extend from the collar 125 at a linear but angled orientation. In this embodiment, the collar 125 also can include an alternative registration element or keyway 128 that interfits with a key 148 disposed on the ferrule 140. This can enable the retainer element to register consistently and in the desired orientation so that the tabs 121 are aligned with the respective slots 141 of the blade and/or the blades 130 themselves.

Figure 12:
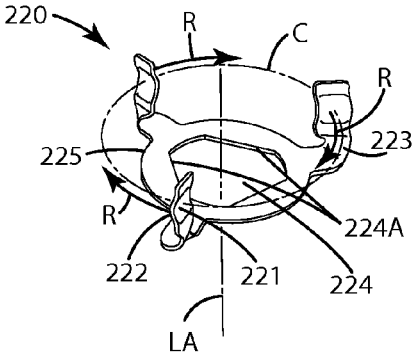
FIG. 12 is a perspective view of the retainer element thereof.
Figure 11:
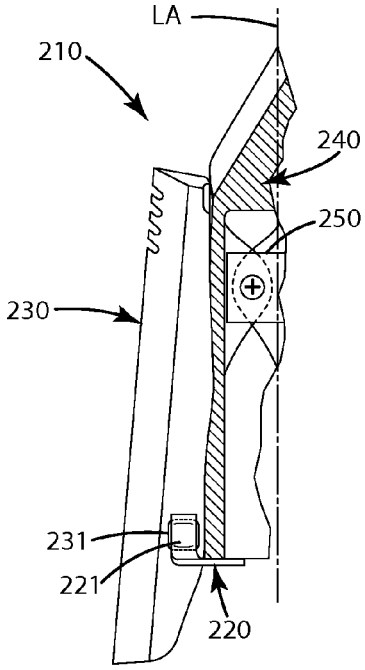
FIG. 11 is a section view of a second alternative embodiment of the broadhead including a retainer element.

FIGS. 11 and 12 illustrate a second alternative embodiment of the broadhead generally designated 210. This embodiment is similar to the embodiments described above in construction and operation with a few exceptions. For example, the blades 230 are joined with a carriage element 250 that slides within an internal compartment of the ferrule 240. The blades can define a recess 231 extending at least partially therethrough. The retainer element 220 includes tab 221 oriented to engage the recess 231 and generally constrain the blades in the retracted mode as shown in FIG. 11. The retainer element 220 can include a collar 225 defining an aperture 224 that is configured to accommodate the stem of the ferrule as with the embodiments above. The tabs 221 can extend outwardly and forwardly relative to the collar 225, generally toward the tip 242 of the ferrule. The tabs 221 can include a curved or projected portion 221 that is configured to engage and fit within the recess 231. The collar 225, and in particular the aperture 224, can include registration elements 224A which are shown as flat portions configured to engage lands of the stem. The engagement of the lands with the collar, and in particular, the registration elements 224 can prevent the collar 225 and the retaining element 220 from rotating relative to the ferrule. In turn, this can enable the tabs 221 to exert a force R against the blades 230 within the recesses. This force R can be tangential to a circle C that circumferentiates the longitudinal axis. Such a force R can temporarily secure the blades in a retracted mode.

Although not shown, alternatively, each of the respective tabs 221 can be paired with an opposing tab to define a retainer slot (similar to the current embodiment described above) so that the blade is entrapped between the opposing tabs. Those tabs can clampingly engage the blade and can be registered with the respective recess 231.

Figure 13:
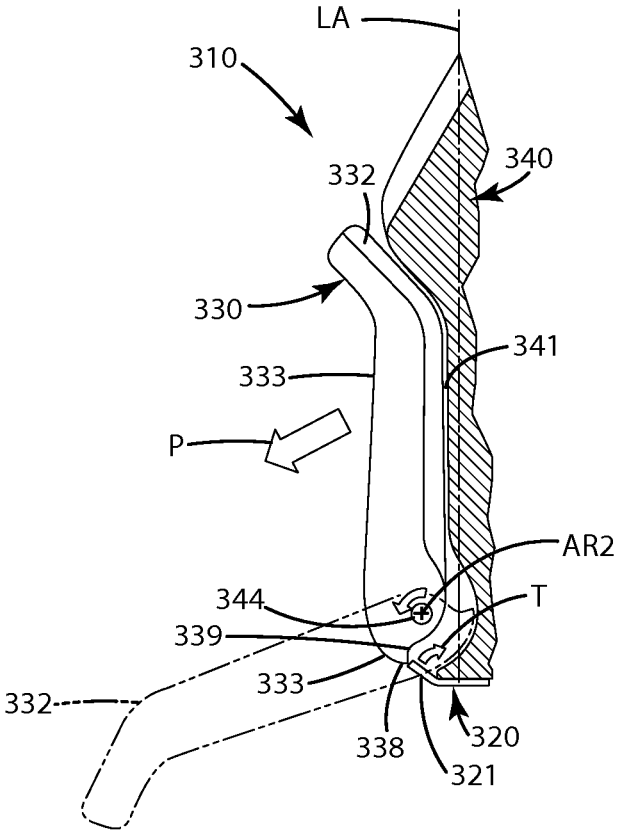
FIG. 13 is a section view of a third alternative embodiment of the broadhead including a retainer element.
Figure 14:
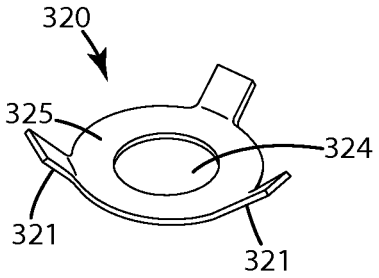
FIG. 14 is a perspective view of the retainer element thereof.

A third alternative embodiment of the broadhead is illustrated in FIGS. 13 and 14 and generally designated 310. This embodiment is similar in construction and operation to the embodiments described above with a few exceptions. For example, this broadhead can include one or more pivoting blades 330. In general the blades 330 pivot in the direction P about an axis of a rotation AR2. This axis of a rotation AR2 can correspond to a pivot pin or other element 344.

This pivoting type of mechanical broadhead can generally pivot from the retracted mode shown in solid lines to the expanded mode shown in broken lines in FIG. 13. In the retracted mode, the cutting edge 332 generally faces toward the longitudinal axis LA. In the expanded mode, however, the cutting edge 332 shown in broken lines extends radially outwardly away from the longitudinal axis LA. In this embodiment, the retainer element 320 can include one or more tabs 321 that engage respective ones of the blades 330. The blade can be configured to include a hook or projection 338 disposed on an inner edge 333 of a blade. The hook or projection 338 can be immediately adjacent a recess 339. The respective tabs 321 can engage the hook and be at least partially located within the recess 339.

Upon engagement with a target, the blade can be forced to rotate about the axis of rotation AR2 in the direction P. With sufficient force, the tab 321 moves inward in the direction of the arrow T sufficiently so that the hook clears the tab 321 and the blade 330 is free to continue rotation to the deployed mode. The tab 321 can thereafter return to its former shape. If desired, the retainer element can be reused by rotating the blade 330 back to the retracted mode and ensuring that the tabs 321 register with the recess 339.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An archery broadhead comprising:

a ferrule having an exterior surface and a longitudinal axis, the ferrule defining a ferrule slot, the ferrule including a stem projecting rearwardly from the ferrule, the stem adapted to join with an arrow;

a blade movably positioned in the ferrule slot, the blade including at least one of a projection and a recess, the blade adapted to be configured in a retracted mode and a deployed mode, a retainer element joined with the ferrule, the retainer element including a first tab located outside the ferrule, radially outward of the exterior surface of the ferrule, wherein the first tab engages the at least one of the projection and the recess of the blade to secure the blade in the retracted mode.

2. The archery broadhead of claim 1, wherein the first tab is a resilient tab, wherein the resilient tab urges the blade outward and away from the longitudinal axis of the ferrule.

3. The archery broadhead of claim 2, wherein the blade includes a forward end and a rearward end with a cutting edge extending therebetween, wherein the first tab urges the rearward end of the blade away from the longitudinal axis of the ferrule.

4. The archery broadhead of claim 1, wherein the retainer element includes a collar defining an aperture, wherein the retainer element is positioned on the stem so that the collar circumferentiates the stem, with the stem positioned through the aperture.

5. The archery broadhead of claim 1, wherein the blade includes a blade side surface, wherein the at least one of a projection and a recess is included on the blade side surface, wherein first tab extends along the blade side surface and resiliently engages the at least one of a projection and a recess of the blade side surface.

6. The archery broadhead of claim 1, wherein the blade includes an inner edge, wherein the at least one of a projection and a recess is included on the inner edge, wherein the first tab engages the at least one of a projection and a recess rearward of the ferrule slot.

7. The archery broadhead of claim 6 wherein the inner edge defines a recess, wherein the first tab includes a portion that engages the periphery of the recess.

8. The archery broadhead of claim 7 wherein the blade is pivotally joined with the ferrule, and wherein the inner edge faces outwardly away from the longitudinal axis in the retracted mode, and inwardly toward the longitudinal axis in the deployed mode.

9. The archery broadhead of claim 1, wherein the retainer element includes a second tab positioned adjacent the first tab with a retainer slot defined therebetween, wherein the blade is configured to slide generally rearwardly through the retainer slot when transitioning from the retracted mode to the deployed mode.

10. An archery broadhead comprising:

a ferrule having an exterior surface and defining a ferrule slot, the ferrule including a stem projecting rearwardly from the ferrule, the stem adapted to join with an arrow, the ferrule having a longitudinal axis;

a blade movably positioned in the ferrule slot, the blade joined with the ferrule and configured to rotate about an axis of rotation, the blade including a blade surface having at least one of a projection and a recess, the blade adapted to be configured in a retracted mode and a deployed mode, a retainer element including a collar, the collar defining an aperture, the retainer element including a first tab and a second tab extending from the collar, the first tab and the second tab defining a retainer slot therebetween, wherein the retainer element is positioned on the stem so that the collar circumferentiates the stem, wherein the blade is positioned adjacent the retainer element so that at least a portion of the blade is positioned in the retainer slot, generally between the first tab and the second tab, wherein at least one of the first tab and the second tab engage the at least one of the projection and the recess of the blade to secure the blade in the retracted mode.

11. The archery broadhead of claim 10 wherein the first tab and second tab are paired with one another and oppose one another on opposite sides of the retainer slot.

12. The archery broadhead of claim 11 wherein the blade includes the blade surface having a projection, wherein the first tab is resiliently biased against the projection to hold the blade in the retracted mode.

13. The archery broadhead of claim 10, wherein the first tab and the second tab of the retainer element are located outside the ferrule, adjacent the exterior surface of the ferrule, and generally located on opposing sides of the ferrule slot, wherein the retainer slot is aligned generally in parallel with the ferrule slot, whereby as the blade transitions from the retracted mode to the deployed mode, the blade slides through the ferrule slot and the retainer slot.

14. The archery broadhead of claim 10, wherein the first and second tabs are resiliently attached to the collar, wherein the blade includes a forward end and a rearward end with a cutting edge extending therebetween, wherein the first tab and the second tab are configured to urge the rearward end of the blade away from the longitudinal axis of the ferrule.

15. The archery broadhead of claim 10 wherein the blade surface defines a recess, wherein at least one of the first tab and the second tab engage the recess of the blade to secure the blade in the retracted mode.

16. The archery broadhead of claim 10 wherein the blade is a rearward deploying blade and slides at least partially within the ferrule slot when transitioning from the retracted mode to the deployed mode.

17. An archery broadhead comprising:

a ferrule including a longitudinal axis and a stem, the stem configured to join with an arrow;

a blade joined with the ferrule and movable from a retracted mode to a deployed mode, a retainer element including a collar, the collar defining an aperture, the retainer element positioned so that the stem projects through the aperture of the collar, the collar including a tab projecting radially outwardly, away from the longitudinal axis, the tab positioned adjacent and engaging the blade, external to the ferrule, to temporarily secure the blade in the retracted mode, wherein the blade includes a blade side surface, wherein the tab engages at least one of a recess and a projection included on the blade side surface.

18. The archery broadhead of claim 17 wherein the tab is constructed from a resilient material, wherein the tab is configured to urge the blade to the retracted mode, but configured to flex when the blade engages a target so as to enable the blade to transition from the retracted mode to the deployed mode.

19. The archery broadhead of claim 17 wherein the tab is configured to flex radially inwardly toward the longitudinal axis when the blade engages a target.

* * * * *